US005080267A

United States Patent [19]

Yogo

[11] Patent Number: 5,080,267

[45] Date of Patent: Jan. 14, 1992

[54] TEXTILE WEB CORRUGATING MACHINE

[75] Inventor: Takeyoshi Yogo, Osaka, Japan

[73] Assignee: Taketaro Yoshizumi & Co., Ltd., Osaka, Japan

[21] Appl. No.: 544,237

[22] Filed: Jun. 26, 1990

[30] Foreign Application Priority Data

Jun. 27, 1989 [JP] Japan ..... 1-164563

[51] Int. Cl.[5] ..... A41H 43/00; D06J 1/06

[52] U.S. Cl. ..... 223/30; 223/28; 223/37; 112/132

[58] Field of Search ..... 223/30, 31, 32, 33, 223/28, 37, 38; 112/132, 134, 135, 144; 26/21

[56] References Cited

U.S. PATENT DOCUMENTS

| | | | |
|---|---|---|---|
| 564,893 | 7/1896 | Kippels et al. | 223/30 |
| 671,790 | 4/1901 | Chandler | 223/30 |
| 1,809,716 | 6/1931 | McDonough | 223/30 |
| 1,888,232 | 11/1932 | McDonough | 223/30 |
| 2,632,495 | 3/1953 | Agee | 223/28 |
| 2,979,240 | 4/1961 | Liebeskind | 223/30 |
| 3,205,854 | 9/1965 | Lyons | 223/30 |
| 3,232,696 | 6/1967 | Liebeskind | 223/30 |
| 3,333,559 | 8/1967 | Benz | 223/30 |
| 3,390,218 | 6/1968 | Painter et al. | 223/30 |
| 4,619,211 | 10/1986 | Semon et al. | 112/132 |
| 4,650,102 | 3/1987 | Arbetter | 223/28 |

*Primary Examiner*—Werner H. Schroeder
*Assistant Examiner*—Bibhu Mohanty

[57] ABSTRACT

A textile web corrugating machine comprises a support table along which a textile web is transported, a folding plate disposed above the support table for folding in a generally zig-zag fashion the textile web then as it passed below the folding plate, a retainer member positioned above the support table in face-to-face relationship with the folding means for urging folds successively formed on the textile web into a web transport passage positioned downstream of the support table with respect to the direction of transport of the textile web, and a compressing unit disposed along the web transport passage for applying a compressive force to the successively formed folds from above and also from a lateral direction.

9 Claims, 6 Drawing Sheets

TEXTILE WEB CORRUGATING MACHINE

BACKGROUND OF THE INVENTION

1. Field of the Invention

The present invention relates to a machine for gathering or corrugating a web of textile material over the length thereof.

2. Description of the Prior Art

In general, a web of textile material is often required to have a substantial thickness depending on the application thereof and, for this purpose, the web of textile material is gathered or corrugated over the length thereof so that the resultant corrugated web of textile material can have a required thickness.

As far as the textile web having a substantial thickness is concerned, one of the textile webs currently available in the market is of a type wherein, as shown in FIG. 7 of the accompanying drawings, textile fibers generally identified by 1 are oriented in two dimensions in transverse directions generally parallel to and perpendicular to the lengthwise direction of the textile web. Another one of the conventional textile webs is of a type wherein, as shown in FIG. 8 of the same, the textile fibers are oriented in two dimensions not only in the transverse directions parallel to and perpendicular to the lengthwise direction thereof, but also in a direction generally parallel to the thickness thereof as indicated by D. Both of the conventional textile webs shown respectively in FIGS. 7 and 8 contain binder particles 2 dispersed therein to bind the textile fibers 1 together.

As a further one of the conventional textile webs, a needle-punched carpet is well known as shown in FIG. 9. The needle-punched carpet is formed by needle-punching a layer of textile fibers to avoid separation of the textile fibers and also to make the textile fibers collected in a desired density while exhibiting a desired physical strength in both of directions parallel to and transverse to the lengthwise direction thereof.

Any one of the conventional textile webs shown respectively in FIGS. 7 and 8 is prepared by collecting textile fibers on a convey or as the textile fibers are discharged at high speed onto the conveyor or laminating the discharged textile fibers. However, in order for the textile web to have a relatively great thickness, the machine for the manufacture thereof is required to be expensive and bulky. Also, as far as the conventional textile web wherein the textile fibers are oriented in the two or three dimensions, the manufacture of the textile web having an increased thickness, for example, 20 mm or greater, requires a needle-punching operation to be effected thereto, followed by laminating plural textile webs together by the use of a needle-punching technique.

In addition, in order for the textile web shown in any one of FIGS. 7 and 8 to have a relatively high fiber density, it is necessary to compress and heat-treat bulky fiber webs, rendering the machine to be bulky.

With respect to the conventional textile web shown in FIG. 9, since the punching operation is effected in a direction D generally parallel to the thickness of the textile web, a difficulty is encountered in driving a long felt needle across the thickness of the textile web. Therefore, in the manufacture of the textile web shown in FIG. 9, a plurality of needle felts are sewed together by the felt needle, posing a problem in that the thickness of the resultant textile web is limited. In other words, the technique to make the textile web shown in FIG. 9 is ineffective to provide the textile web having a required fiber density and also having a required thickness.

SUMMARY OF THE INVENTION

Accordingly, the present invention has been devised for the purpose of substantially eliminating the above discussed problems found in the manufacture of the prior art textile webs and has been intended to provide a textile web corrugating machine effective to provide a high quality textile web having a required overall thickness and a required elasticity, without substantially requiring the use of a bulky and complicated equipment.

To this end, the textile web corrugating machine according to the present invention comprises a support table along which a textile web is transported, a folding means disposed above the support table and operable to fold in a generally zig-zag fashion the textile web then passing through a space delimited by the folding means and the support table, a retainer means positioned above the support table in face-to-face relationship with the folding means and operable to urge folds successively formed on the textile web into a web transport passage positioned downstream of the support table with respect to the direction of transport of the textile web, and a compressing means disposed along the web transport passage for applying a compressive force to the successively formed folds from above and also from a lateral direction.

According to the present invention, since the folding means is operable to corrugate the textile web in a generally zig-zag fashion in a direction conforming to the lengthwise direction of the textile web while the retainer means urges the successively formed folds on the textile web into the web transport passage, an adjustment of the distance between the folding means and the retainer means can result in an adjustment of the amount of the textile web being transported, thereby making it possible to adjust the height of each of the successively formed folds on the textile web. Accordingly, the machine according to the present invention is effective to provide the corrugated textile web product having a number of folds of any desired height.

Also, since the textile web can be corrugated to provide the corrugated textile web product, the corrugated textile web can exhibit a substantially increased resistance to compression in a direction across the thickness thereof. In addition, the orientation of the fibers used in the textile web is, when the textile web is processed to the corrugated textile web product, changed to conform to the direction of thickness of the corrugated textile web product, the latter can have an increased thickness while exhibiting a required elasticity.

The textile web to be corrugated or gathered by the machine of the present invention may have any thickness and, therefore, the machine need not be assembled in a bulky size.

Also, during the passage of the corrugated textile web product through the web transport passage, a compressive force acts on the consecutive folds on the textile web from above and also from a lateral direction and, therefore, the folds will not be deformed, making it possible to manufacture the corrugated textile web products of substantially uniform quality.

BRIEF DESCRIPTION OF THE DRAWINGS

In any event, the present invention will become more clearly understood from the following description of a preferred embodiment thereof, when taken in conjunction with the accompanying drawings. However, the embodiment and the drawings are given only for the purpose of illustration and explanation, and are not to be taken as limiting the scope of the present invention in ant way whatsoever, which scope is to be determined solely by the appended claims. In the accompanying drawings, like reference numerals are used to denote like parts throughout the several views, and:

DETAILED DESCRIPTION OF THE EMBODIMENTS

Figure 1:
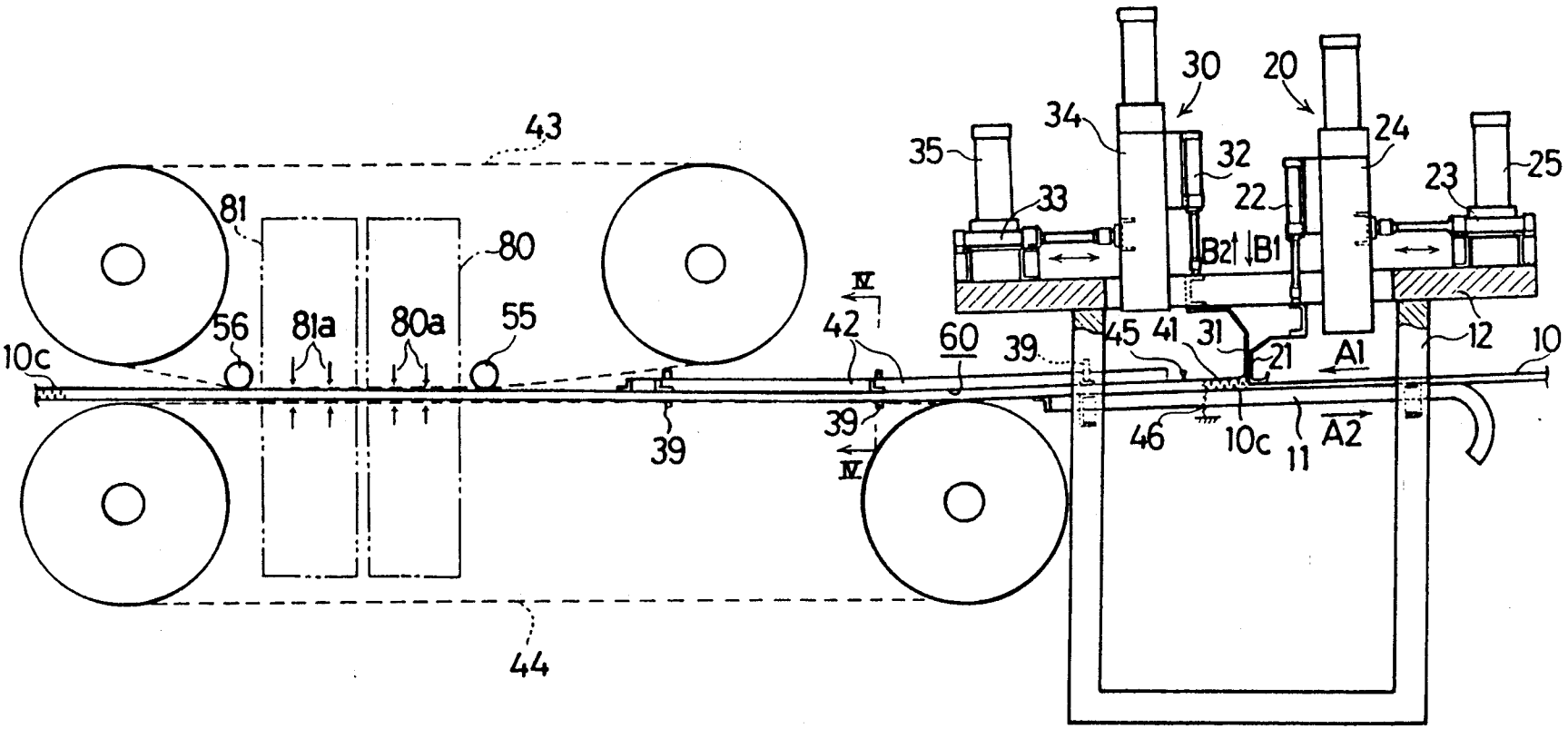
FIG. 1 is a schematic side view, with a portion cut away, showing a textile web corrugating machine embodying the present invention.
Figure 2A:
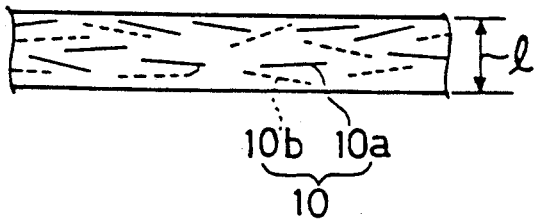
FIG. 2 comprised of FIGS. 2(*a*) to 2(*c*) are schematic side views showing the sequence of formation of a textile web according to the present invention.
Figure 2B:
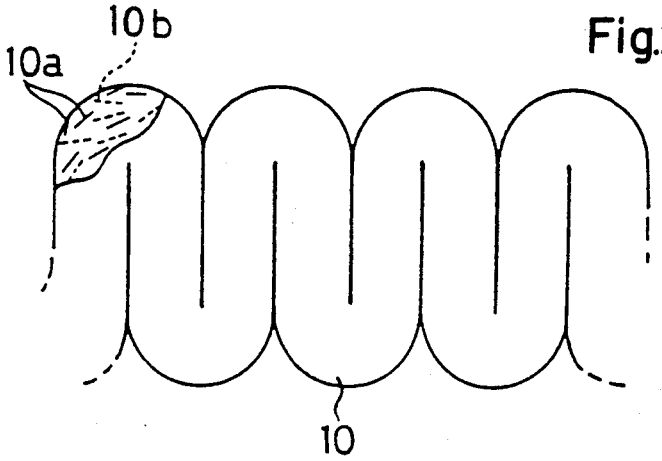
Figure 2C:
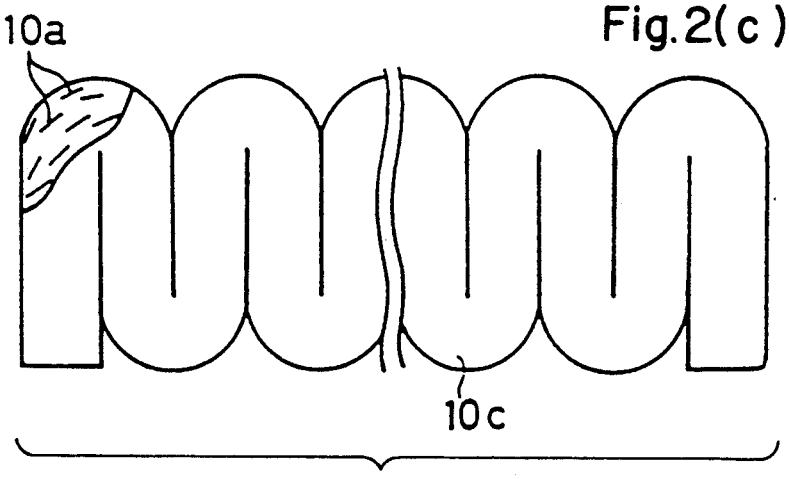

Referring first to FIG. 1, a textile web corrugating machine shown therein comprises a support table 11 along which a sheet-like textile web 10 is supported in a direction shown by the arrow A1. The textile web 10 may be a non-woven fabric comprising, as shown in FIG. 2(*a*), non-woven fibers 10*a* bonded together by a fiber binder 10*b* and has a thickness l preferably within the range of 8 to 30 mm although not limited thereto.

Material for the non-woven fibers 10*a* may be chosen from, for example, natural cotton, rayon and high-melting point fibers of polyester or polypropylene resin.

The fiber binder 10*b* used in the textile web 10 may be low-melting point synthetic fibers such as, for example, thermally fusible compound fibers of polypropylene resin known as "ES Fibers" manufactured and sold by Chisso Kabushiki Kaisha of Japan, polyester fiber known as "TBS Fibers" manufactured and sold by Teijin Kabushiki Kaisha of Japan The fiber binder 10*b* is so processed as to represent fibers each having a length generally within the range of 38 to 160 mm. In the practice of the present invention, the fibers may be oriented either in two dimensions or in three dimensions.

As a method of making the textile web 10, any one of a method of mixing the non-woven fibers 10*a* with the binder 10*b* and a method of spreading the binder 10*b* in the form of a powder over the non-woven fibers 10*a* may be employed. It is, however, to be noted that FIG. 2(*b*) illustrates the textile web 10 having been corrugated over the length thereof and FIG. 2(*c*) illustrates the corrugated textile web 10 having been heat-treated to provide a final corrugated web product 10*c*.

The web corrugating machine also comprises a folding unit 20 and a retainer unit 30 both supported above the support table 11 and positioned in face-to-face relationship as shown in FIG. 1. All of the support table 11, the folding unit 20 and the retainer unit 30 are mounted on and supported by a machine frame structure generally identified by 12.

Figure 3:
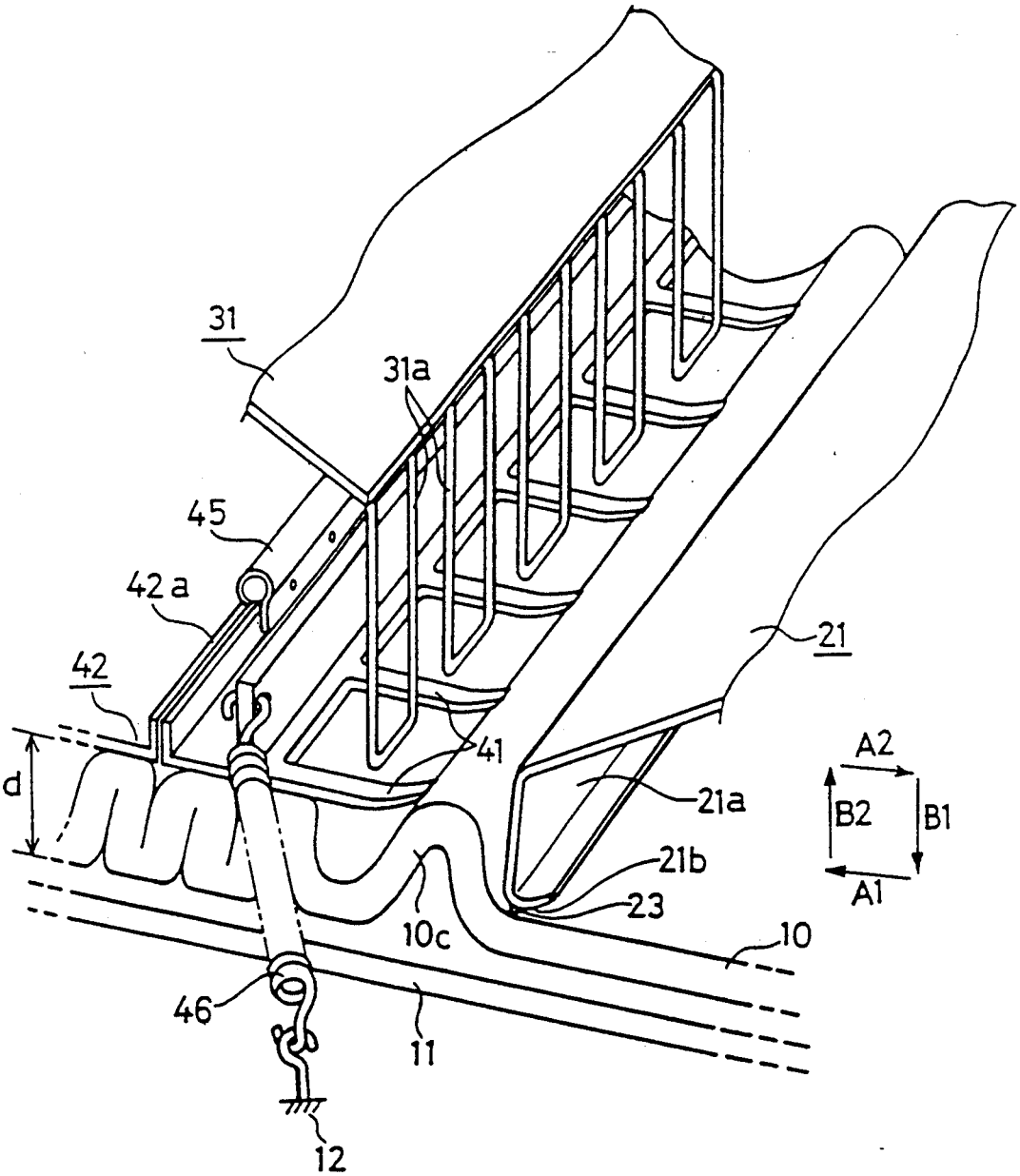
FIG. 3 is a schematic perspective view, on an enlarged scale, of a portion of the textile web corrugating machine, showing how a textile web is corrugated or gathered.

As best shown in FIGS. 1 and 3, the folding unit 20 comprises a folding plate 21 extending generally over a width of the textile web 10, at least one vertical cylinder 22 for driving the folding plate 21 up and down, i.e., in a generally vertical direction perpendicular to the direction A1 of transport of the textile web 10, a slide block 24 for the support of the vertical cylinder 22 thereon, at least one horizontal cylinder 23 for driving the slide block 24 and, hence, the vertical cylinder 22 generally in a horizontal direction parallel to the direction A1 of transport of the textile web 10, and a fixed support block 25 for the support of the horizontal cylinder 23.

As best shown in FIG. 3, the folding plate 21 has upper and lower side portions lying at an angle relative to each other so as to assume a generally L-shaped cross-section, with the lower side portion 21*a* lying in a plane substantially perpendicular to the direction A1 of transport of the textile web 10. The lower side portion 21*a* of the folding plate 21 has a lower side edge 21*b* representing a generally J-shaped cross-section and adapted to be brought into contact with the textile web 10 being transported above the support table 11. The lower side edge 21*b* which is connected to the folding plate 21 through the lower side portion 21*a* has a plurality of spikes 23 secured thereto so as to protrude outwardly therefrom, said spikes 23 being operable to avoid any possible slip of the lower side edge 21*b* relative to the textile web 10 being transported in the direction A1.

The folding plate 21 is adapted to be driven by the vertical cylinder 22 so as to move in downward and upward directions shown by the arrows B1 and B2, respectively, which are substantially perpendicular to the direction A1 of transport of the textile web 10, and to be driven by the horizontal cylinder 23 so as to move in forward and rearward directions shown by the arrows A1 and A2, respectively, which are parallel to the direction A1 of transport of the textile web 10.

More specifically, the selective extension and retraction of a piston rod of the vertical cylinder 22 result in the movement of the folding plate 21 in the downward and upward directions B1 and B2, respectively, and similarly, the selective extension and retraction of a piston rod of the horizontal cylinder 23 result in the movement of the folding plate 21 in the forward and rearward directions A1 and A2, respectively. When the folding plate 21 is moved in the downward direction B1, the lower side edge 21*b* thereof is brought into contact with the textile web 10 and, therefore, the subsequent movement of the folding plate 21 in the forward direction A1 effected by the extension of the piston rod of the horizontal cylinder 23 results in the formation of a single fold on the textile web 10.

As the folding plate 21 is repeatedly moved by a combined operation of the vertical and horizontal cylinders 22 and 23 so as to depict a generally rectangular trajectory as shown in a right hand portion of FIG. 1, the textile web 10 can be successively corrugated to form a plurality of folds over the length of the textile web 10 as shown. As will be subsequently described, during the formation of each fold on the textile web 10, the textile web 10 being transported is held still by the action of the retainer unit 30 in cooperation with a back-up compressor unit.

The retainer unit 30 comprises a retainer member 31 extending generally over the width of the textile web 10 and substantially parallel to the folding plate 21 of the folding unit 20, at least one vertical cylinder 32 operable to move the retainer member 31 up and down in a direction generally perpendicular to the direction A1 of transport of the textile web 10, a slide block 34 for the support of the vertical cylinder 32 thereon, a horizontal cylinder 33 operable to move the slide block 34 and, hence, the vertical cylinder 32 selectively in forward and rearward directions parallel to the direction A1 of transport of the textile web 10, and a fixed support block 35 for the support of the horizontal cylinder 33.

The retainer member 31 is positioned at a location spaced a distance from the folding plate 21 and has a lower side edge to which a plurality of generally U-shaped fingers 31*a* are secured so as to extend downward towards the textile web 10 being transported along the support table 11. The U-shaped fingers 31*a* are equidistantly spaced from each other over the width of the textile web 10 and extend into respective spaces defined by a generally comb-shaped guide 41 as will be described later.

As is the case with the folding plate 21, the retainer member 31 is adapted to be driven by the vertical cylinder 32 so as to move in downward and upward directions shown by the arrows B1 and B2, respectively, which are substantially perpendicular to the direction A1 of transport of the textile web 10, and to be driven by the horizontal cylinder 33 so as to move in forward and rearward directions shown by the arrows A1 and A2, respectively, which are parallel to the direction A1 of transport of the textile web 10. More specifically, the selective extension and retraction of a piston rod of the vertical cylinder 32 result in the movement of the retainer member 31 in the downward and upward directions B1 and B2, respectively, and similarly, the selective extension and retraction of a piston rod of the horizontal cylinder 33 result in the movement of the retainer member 31 in the forward and rearward directions A1 and A2, respectively.

When the retainer member 31 is moved in the downward direction B1, the U-shaped fingers 31*a* carried by the retainer member 31 are engaged in between the neighboring folds 10*a* on the textile web 10 to facilitate the formation of the fold 10*a* on one side thereof adjacent the folding plate 21. The movement of the retainer member 31 effected by a combined operation of the vertical and horizontal cylinders 32 and 33 so as to depict a generally rectangular trajectory similar to that depicted by the movement of the folding plate 21 takes place in unison with that of the folding plate 21.

The back-up compressor unit comprises a plurality of generally rectangular presser plates 42 positioned along a passage 60 for the transport of the textile web therethrough in side-to-side abutting fashion each of said rectangular presser plates 42 extending in a direction parallel to the widthwise direction of the textile web 10. One of the presser plates 42 adjacent the folding plate 21 has a free side edge 42*a* to which the comb-shaped guide 41 having a plurality of equally spaced guide fingers is hingedly connected by means of a hinge 45. The comb-shaped guide 41 is pivotable about the hinge 45 relative to the presser plate 42 adjacent the folding plate 21 and is normally urged by a coil spring 46, disposed between the comb-shaped guide 41 and a portion of the machine frame structure 12, to a pressing position at which the comb-shaped guide 41 is spaced a predetermined distance d upwardly from the support table 11 while pressing the folds 10*a* formed on the textile web 10 so that the folds 10*a* being formed on the textile web 10 can be smoothly guided into the gap between the comb-shaped guide 41 and the support table 11.

Figure 4:
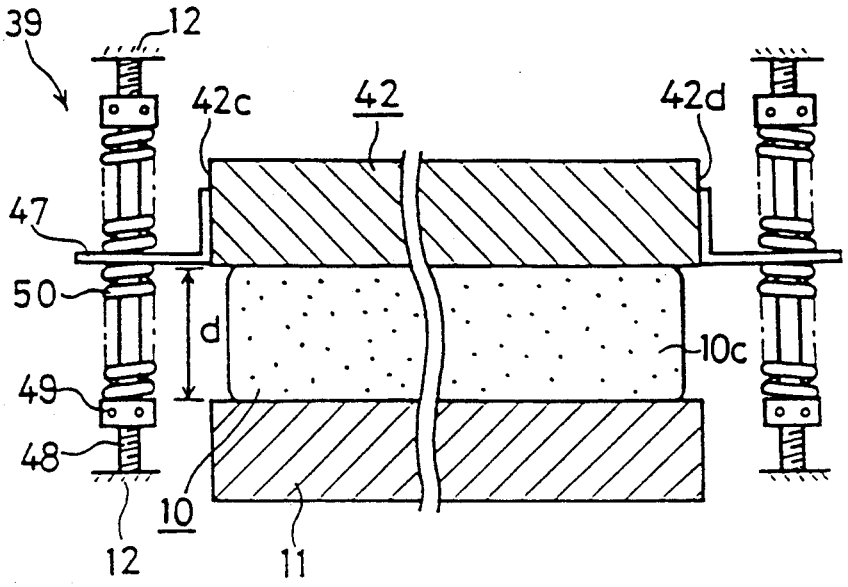
FIG. 4 is a cross-sectional view, on a somewhat enlarged scale, taken along the line IV—IV in FIG. 1.

As described above, the presser plates 42 are spaced the distance d upwardly from the support table 11. As best shown in FIG. 4, each of those presser plates 42 has its opposite ends 42*c* and 42*d* retained by respective pluralities of holders 39. Each of the holders 39 for each end 42*c* and 42*d* of each presser plate 42 comprises a screw rod 48 having its opposite ends rigidly secured to different portions of the machine frame structure 12 and extending in a direction perpendicular to the direction A1 of transport of the textile web 10 through a respective bracket 47 rigidly secured to the associated end 42*c* and 42*d* of the respective presser plate 42., a pair of ring nuts 49 threadingly mounted on the screw rod 48 and positioned above and below the bracket 47; and a pair of coil springs 50 mounted on the screw rod 48 and positioned between the ring nuts 49 and the bracket 47. Accordingly, turning any one of the ring nuts 49 to adjust the compressive force exerted by the associated coil spring 50 positioned between such one of the ring nuts 49 and the bracket 47 can result in an adjustment of the distance d defined between the respective presser plate 42 and the support table 11.

Figure 5:
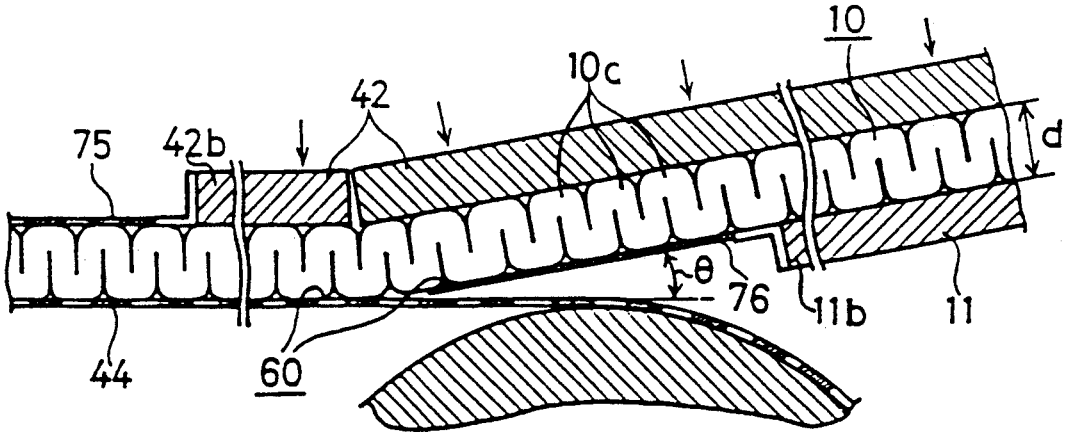
FIG. 5 is a side sectional view of another portion of the textile web corrugating machine showing the position of a presser plate and the inclination of a support table.
Figure 6A:
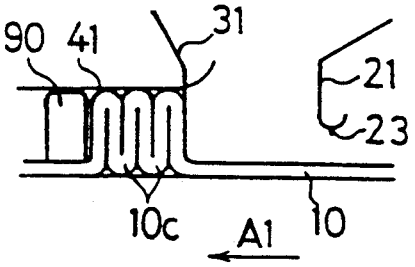
FIG. 6 comprised of FIGS. 6(*a*) to 6(*h*) is a diagram showing the sequence of corrugation or gathering of the textile web which takes place in the textile web corrugating machine according to the present invention.
Figure 6B:
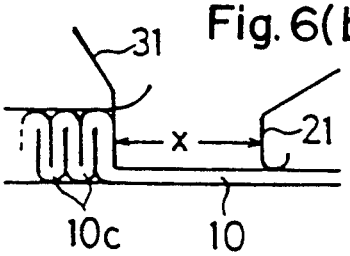
Figure 6C:
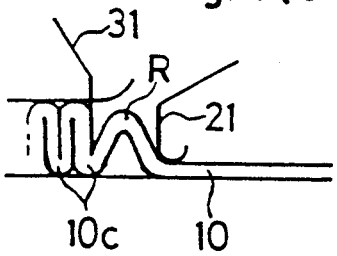
Figure 6D:
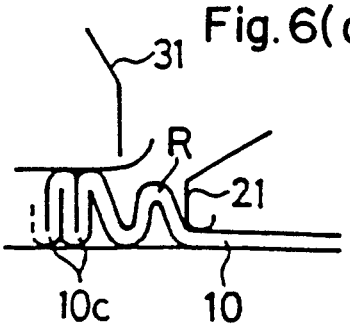
Figure 6E:
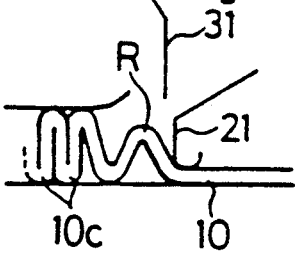
Figure 6F:
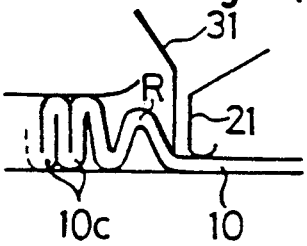
Figure 6G:
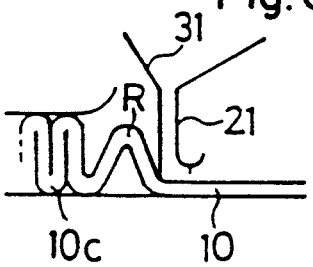
Figure 6H:
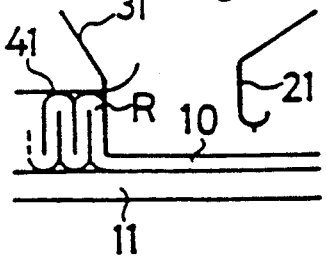
Figure 7:
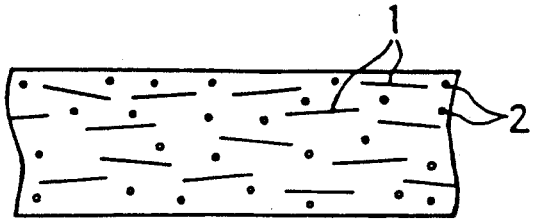
FIGS. 7 to 9 are schematic side sectional views of the conventional textile webs, respectively.
Figure 8:
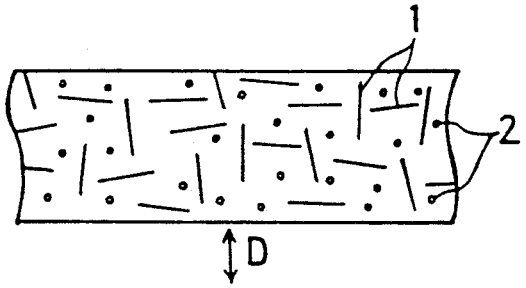
Figure 9:
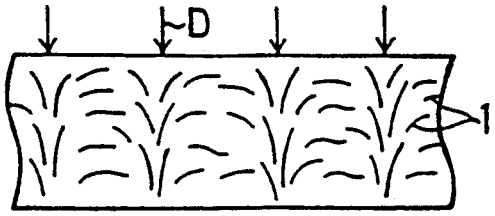

As best shown in FIG. 5, one of the presser plates 42 adjacent the support table 11 is upwardly inclined at a predetermined angle $\theta$ relative to the horizontal plane and, similarly, the support table 11 is inclined upwardly at the same angle $\theta$ so that the path 50 along which the textile web 10 is transported can be bent at a location corresponding to the joint between the presser plates 42 as shown in FIG. 5.

Thus, it will readily be understood that the adjustment of the distance d between the presser plates 42 and the support table 11 and the distance x between the side portion 21*a* lower side portion 21*a* of the folding plate 21 and the U-shaped fingers 31*a* carried by the retainer member 31 as indicated in FIG. 6(*b*) can result in an adjustment of the height of each fold 10*a* being formed on the textile web 10 and, hence, the overall thickness of the eventually formed corrugated product, so that the successive folds 10*a* formed on the textile web 10 can be smoothly transported towards a mesh conveyor unit as will be described later.

Referring still to FIG. 5, delivery plates 75 and 76 are connected to a forward edge 42*b* of one of the presser plates 42 remote from the support plate 11 and a forward edge 11*b* of the support table 11. The delivery plates 75 and 76 serve to guide the textile web 10, having been corrugated, towards a delivery gap between upper and lower mesh conveyors 43 and 44 without the corrugated textile web 10 being deformed, said upper and lower mesh conveyors 43 and 44 being best shown in FIG. 1.

As shown in FIG. 1, each of the mesh conveyors 43 and 44 comprises a generally endless perforated belt trained between drive and driven rolls. A lower run of the perforated belt of the upper mesh conveyor 43 is normally urged towards the corrugated textile web 10 by means of spaced apart urging rolls 55 and 56 positioned inwardly of such lower run of the perforated belt of the upper mesh conveyor 43 and extending in a direction parallel to the widthwise direction of the textile web 10. Positioned between the urging rolls 55 and 56 are a heating furnace 80 and a cooling unit 81 at upstream and downstream sides, respectively, with respect to the direction A1 of transport of the textile web 10.

The heating furnace 80 is of a construction comprising a source of heated air 80*a* applied to the corrugated textile web 10 to fuse the binder 10*b* contained therein thereby to bind the fibers 10*a* (FIG. 2(*a*) together. The temperature of the heated air 80*a* is so selected as to be higher than the melting point of the binder 10*b* used and lower than the melting point of the non-woven fibers 10*a* and, for example, within the range of 60° to 180° C., and preferably within the range of 140° to 160° C. The cooling unit 81 is positioned downstream of the heating furnace 80 and is operable to apply a cooling air 81*a* to the heat-treated corrugated textile web to facilitate hardening or curing of the fused binder to fix the folds 10*c*. Thus, it will readily be seen that, when the corrugated textile web 10 having been so heat-treated in the manner as described above during the passage thereof through the heating furnace 80 is passed through the cooling unit 81, the folds 10*c* on the textile web 10 can be fixed to provide the finally corrugated textile web product. It is to be noted that the cooling which takes place during the passage of the corrugated textile web 10 through the cooling unit 81 is effective to facilitate an easy separation of the corrugated textile web 10 from any one of the mesh conveyors 43 and 44.

While the textile web corrugating machine is so constructed as hereinbefore described, it operates in the following manner. The operation of the machine will now be described with particular reference to FIG. 6.

In the first place, as shown in FIG. 6(*a*), an attendant worker has to manually fold a leading end portion of the textile web 10 to form at least one fold and then to place a weight 90 on a leading end. The weight 90 is used to avoid any possible stretch of that leading end portion of the textile web 10 which has once been manually folded. After the placement of the weight 90 in the manner as hereinabove described, the cylinders 22, 23, 32 and 33 have to be actuated to perform successively such operations as shown in FIGS. 6(*b*) to 6(*h*).

More specifically, starting from a condition shown in FIG. 6(*b*) in which the folding plate 21 is lowered to bring the side edge 21*b* into contact with the textile web 10 with the spikes 23 driven thereinto, the folding plate 21 is moved in the forward direction to form a single fold R. At this time, the U-shaped fingers 31*a* carried by the retainer member 31 are lowered to facilitate the formation of a portion of the textile web 10 between the folding plate 21 and the U-shaped fingers 31*b* to be folded as shown by R as shown in FIG. 6(*c*). Thereafter, as shown in FIGS. 6(*d*) to 6(*f*), the U-shaped fingers 31*a* fast with the retainer member 31 are upwardly shifted as shown in FIG. 6(*d*) and then driven in the rearward direction as shown in FIG. 6(*e*) to move over the fold R being formed, finally lowered again to touch one of roots of the fold R adjacent the folding plate 21 as shown in FIG. 6(*f*). During this process shown in FIGS. 6(*d*) to 6(*f*), the folding plate 21 is held in the lowered position with the spikes 23 driven into the textile web 10. After the condition shown in FIG. 6(*f*) has been attained, that is, after the U-shaped fingers 31*b* fast with the retainer member 31 have been lowered to touch that one of the roots of the fold R adjacent the folding plate 21, the folding plate 21 is upwardly shifted with the spikes 23 disengaged from the textile web 10, as shown in FIG. 6(*g*), and is then driven in the rearward direction and, at the same time, the U-shaped fingers 31*a* fast with the retainer member 31 are driven in the forward direction as shown in FIG. 6(*h*). The forward movement of the U-shaped fingers 31 rigid with the retainer member 31 shown in FIG. 6(*h*) results in a compression of the fold R against the previously formed fold or folds with the U-shaped fingers 31 entering respective spaces defined between the guide fingers of the comb-shaped guide 41, allowing the compressed folds to move into the gap between the comb-shaped guide 41 and the support table 11.

By repeating the sequence of operation described above, the textile web 10 can be continuously corrugated to provide the corrugated textile web product. By way of example, with the textile web corrugating machine according to the present invention, the textile web 10 having a thickness of 10 mm can be corrugated to provide the corrugated product having an overall thickness of 30 mm or greater.

Thereafter, the textile web 10 so successively corrugated is transported along the web transport passage 60 in compressed fashion and is subsequently passed through the heating furnace 80 and then through the cooling unit 81 with the folds 10*c* consequently fixed, thereby completing the manufacture of the corrugated textile web product.

Thus, according to the present invention, the folding plate 21 is utilized to corrugate the textile web 10 while the retainer member 31 is utilized to force each fold 10*c* being formed into the web transport passage 60. Accordingly, the adjustment of the distance between the folding plate 21 and the retainer member 31 can result in an adjustment of the amount of the textile web 10 which is forced into the web transport passage whereby the height of each fold formed on the textile web 10 can be adjusted. This means that the machine according to the present invention is effective to provide the corrugated textile web product having a number of folds of any desired height.

Also, since the textile web 10 can be corrugated to provide the corrugated textile web product by the machine according to the present invention, the corrugated textile web can exhibit a substantially increased compressive strength in a direction across the thickness thereof. In addition, the orientation of the fibers used in the textile web is, when the textile web is processed to the corrugated textile web product, changed to conform to the direction of thickness of the corrugated textile web product, the latter can have an increased thickness while exhibiting a required elasticity.

The textile web 10 to be corrugated or gathered by the machine of the present invention may have any thickness and, therefore, the machine need not be assembled in a bulky size.

Also, during the passage of the corrugated textile web product through the web transport passage 60, a compressive force acts on the consecutive folds on the textile web from above and also from a lateral direction and, therefore, the folds 10*c* will not be deformed, making it possible to manufacture the corrugated textile web products of substantially uniform quality.

Furthermore, the adjustment of the distance d and also that of the pressing pressure exerted by the retainer member 31 can result in an adjustment of the compressive force acting so as to press the folds 10*c* on the textile web 10 Therefore, prior to the folds 10*c* being fixed during the passage thereof through the heating furnace 80, the folds 10*c* can be retained in position without being deformed thereby to adjust the density of fibers in a direction parallel to the direction of transport of the textile web 10.

Thus, from the foregoing description of the preferred embodiment of the present invention, the textile web corrugating machine is provided with the folding plate operable to corrugate the textile web to form the folds thereon and the retainer member operable to force the corrugated portion of the textile web into the web transport passage. Therefore, the corrugated textile web product having any desired thickness can be readily obtained.

Also, since the folding of the textile web to form the folds renders the eventually corrugated textile web to exhibit an increased resistance to compression in a direction across the thickness thereof and, also, since the orientation of the fibers contained in the textile web changes from the directions parallel to and transverse to the lengthwise direction of the textile web to the direction conforming to the thickness of the textile web, the eventually corrugated textile web product having an increased thickness and also having a desired elasticity can be obtained.

Yet, since the compressive force is applied from above and also from the lateral direction to the folds formed on the textile web during the passage thereof through the web transport passage, any possible deformation of the folds on the textile web can be avoided, thereby making it possible to provide the corrugated products of substantially uniform quality.

Although the present invention has been fully described in connection with the preferred embodiment thereof with reference to the accompanying drawings which are used only for the purpose of illustration, those skilled in the art will readily conceive numerous changes and modifications within the framework of obviousness upon the reading of the specification herein presented of the present invention. For example, although in the foregoing illustrated embodiment reference has been made to the single textile web, the machine according to the present invention can accommodate a plurality of textile webs laminated or positioned one above the other. Where the textile webs in a multilayered structure are employed as a material for, for example, an air filter, the fibers in the respective textile webs may have different diameters so that relatively large particles ca be trapped by the fibers of relatively large diameter and small particles can be trapped by the fiber of relatively small diameter, thereby enhancing the filtering efficiency.

Also, the corrugated textile web product manufactured by the use of the machine according to the present invention can be used not only as an air filtering material for trapping particles floating in the air, but also as an aqueous filtering material for trapping particles contained in a liquid medium or for filtering water in a swimming pool. Yet, the corrugated textile web product can also be used as a cushioning material utilizable in a chair, sofa, bed or the like. Where the corrugated textile web produce is enclosed in a textile bag, it can be used as a bedding sheet.

Accordingly, such changes and modifications are, unless they depart from the spirit and scope of the present invention as delivered from the claims annexed hereto, to be construed as included therein.

I claim:

1. A textile web corrugating machine which comprises:

a support table extending in one direction and along which a textile web is transported;

a generally elongated folding means supported above the support table and extending in a direction widthwise of the textile web;

a first drive means for driving the folding means so as to move along a generally rectangular path including a lowering path component, a lowered forward path component, an elevating path component and an elevated rearward path component;

a generally elongated retainer means positioned above the support table at a location spaced a distance from the folding means, said retainer means extending generally parallel to the folding means;

a second drive means for driving the retainer means so as to move along a generally rectangular path including a lowering path component, a lowered forward path component, an elevating path component and an elevated rearward path component;

a means for defining a web transport passage continued from a forward end of the support table with respect to the direction of transport of the textile web;

control means for automatically moving said folding means and said retainer means in synchronized movement to form a fold on the textile web during one cycle of movement of said folding means and said retainer means along their respective generally rectangular paths;

said retainer means being operable to urge the fold formed on the textile web into the web transport passage positioned downstream of the support table with respect to the direction of transport of the textile web; and a compressing means disposed along the web transport passage for applying a compressive force to the successively formed folds.

2. A textile web corrugating machine as set forth in claim 1 wherein said first drive means comprises a pair of cylinders located at substantially a right angle to each other.

3. A textile web corrugating machine as set forth in claim 1 wherein said second drive means comprises a pair of cylinders located at substantially a right angle to each other.

4. A textile web corrugating machine as set forth in claim 1 wherein said compressing means includes a comb shaped guide having spaces therealong.

5. A textile web corrugating machine as set forth in claim 4 wherein said retaining means includes a plurality of fingers.

6. A textile web corrugating machine as set forth in claim 5 wherein said fingers extend into said spaces when said retainer means is lowered.

7. A textile web corrugating machine as set forth in claim 1 wherein said retaining means includes a plurality of fingers.

8. A textile web corrugating machine as set forth in claim 1 wherein conveyor means receives the textile web from said web transport passage.

9. A textile web corrugating machine as set forth in claim 8 wherein a heating furnace means and a cooling unit means are mounted adjacent said conveyor means to heat and cool the textile web.

* * * * *